US007338098B1

(12) United States Patent
O'Kelley et al.

(10) Patent No.: US 7,338,098 B1
(45) Date of Patent: Mar. 4, 2008

(54) DEVICE FOR HOLDING A DOOR OPEN WITH A READY RELEASE MECHANISM

(76) Inventors: James F. O'Kelley, 22365 Sheffield Dr., Moreno Valley, CA (US) 92557; Alan J. O'Kelley, 40194 Avenida Palizada, Murrieta, CA (US) 92563

( * ) Notice: Subject to any disclaimer, the term of this patent is extended or adjusted under 35 U.S.C. 154(b) by 55 days.

(21) Appl. No.: 11/189,150

(22) Filed: Jul. 25, 2005

Related U.S. Application Data

(60) Provisional application No. 60/602,472, filed on Aug. 18, 2004.

(51) Int. Cl.
*E05C 19/00* (2006.01)

(52) U.S. Cl. ..... 292/304; 292/DIG. 15; 16/82

(58) Field of Classification Search ..... 292/342, 292/288, 304, DIG. 15, 136, 108; 16/82, 16/54, 55
See application file for complete search history.

(56) References Cited

U.S. PATENT DOCUMENTS

| | | | | |
|---|---|---|---|---|
| 597,895 | A * | 1/1898 | Chaplin | 292/278 |
| 1,518,643 | A * | 12/1924 | Faubert | 292/198 |
| 5,605,064 | A | 2/1997 | Katayama et al. | |
| 5,689,853 | A * | 11/1997 | Lemmer | 16/82 |
| 5,711,554 | A | 1/1998 | Brown et al. | |
| 5,769,145 | A | 6/1998 | Kwatonowski | |
| 6,141,829 | A | 11/2000 | Boyer | |

* cited by examiner

*Primary Examiner*—Gary Estremsky
(74) *Attorney, Agent, or Firm*—Edward A. Sokolski

(57) ABSTRACT

A device for holding a door open having a ready release mechanism to enable the closing of the door has a mounting bracket fixedly attached to a wall. A latch is pivotally supported on the bracket and a release lever is pivotally supported on the latch. An end piece having a ramped outer surface and a flat inner surface is attached to the end of the latch. As the door moves towards the wall to its fully open position, it rides over the ramped surface and is latched open between the release lever and the mounting bracket. The door is released towards its closed position by its riding over a ramped surface formed by the release lever and the end piece.

8 Claims, 4 Drawing Sheets

DEVICE FOR HOLDING A DOOR OPEN WITH A READY RELEASE MECHANISM

This application enjoys the priority of Provisional Application No. 60/602,472 filed on Aug. 18, 2004.

BACKGROUND OF THE INVENTION

1. Field of the Invention

This invention relates to a device for holding a hinged door open which has a ready release mechanism for releasing the door so that it can be closed.

2. Description of the Related Art

There are many instances where it is difficult for a person to open a closed door and to keep the door open for passage back through. This presents a particular problem for handicapped persons who are in wheel chairs. This is also a problem in situations where persons are carrying a number of articles and have difficulty in using their hands to open and close a door.

A prior art door lock for handicapped persons is described in U.S. Pat. No. 5,605,064 issued Feb. 25, 1997 to Katayama et al. This device operates to control the door knob and is somewhat complicated in structure. Also, it does not operate to keep the door open. U.S. Pat. No. 5,769,145 issued Jun. 23, 1998 to Kwatonowski describes a push bar which extends horizontally over the width of the door and is connected at one end to the door latch to allow unlatching and opening of the door by the application of pressure at any location along the bar as a person might do with a part of his or her body. This device, as for the first mentioned prior art device, does not operate to keep the door open and is somewhat complicated in structure.

SUMMARY OF THE INVENTION

The device of the present invention is of simple and economic structure and can easily be installed on an existing door or door jamb. It further can be used to hold the door open and can readily be released to permit closing of the door with the application of a minimal force.

The device of the invention employs a mounting bracket fixedly attached to a wall adjacent to the hinged end of a door or other convenient mounting support. A latch is pivotally supported on the bracket and a release lever is pivotally supported on the latch. At the remote end of the bracket is an end piece which has a ramped outer surface and a flat inner surface. As the door is moved towards its open position its top end rides over the ramped surface and pivotally drives the latch upwardly and moves to a position between the lever arm and the wall where it is retained in position. The door is released towards its closed position by moving it further in the open direction until it is between the release lever and the wall. This enables the top of the door to pivotally drive the release lever against the top of the end piece permitting the door to ride over the end piece to a free position in its closed direction.

DETAILED DESCRIPTION OF THE INVENTION

Figure 1:
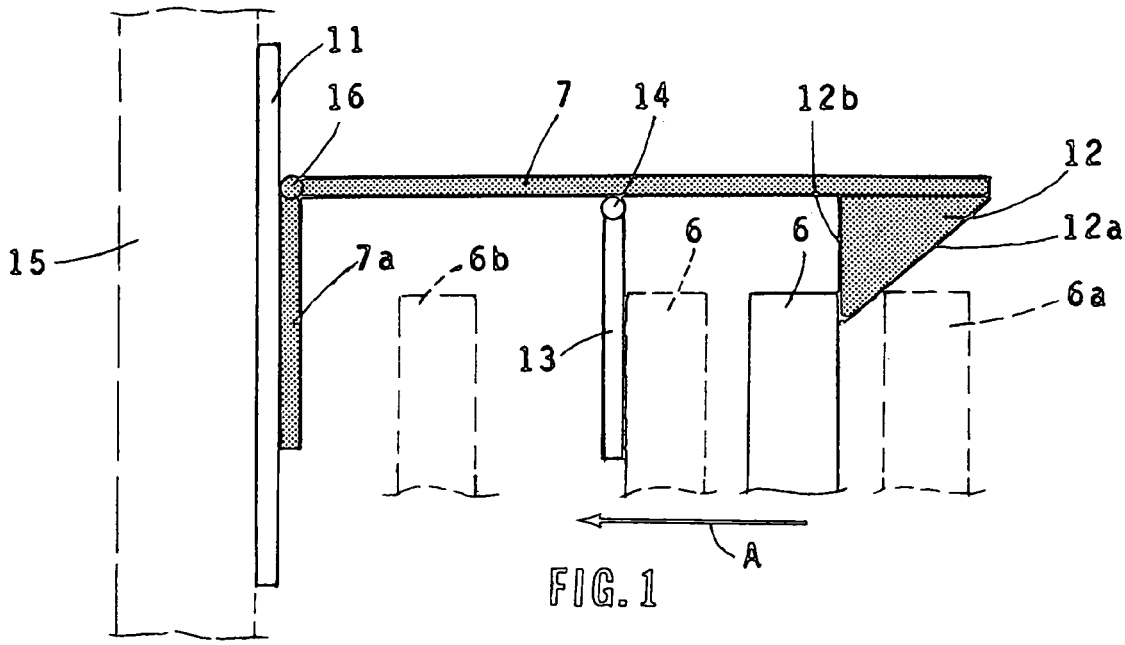
FIG. 1 is a side elevational view of a first embodiment of the invention showing the door held in its open position.
Figure 2:
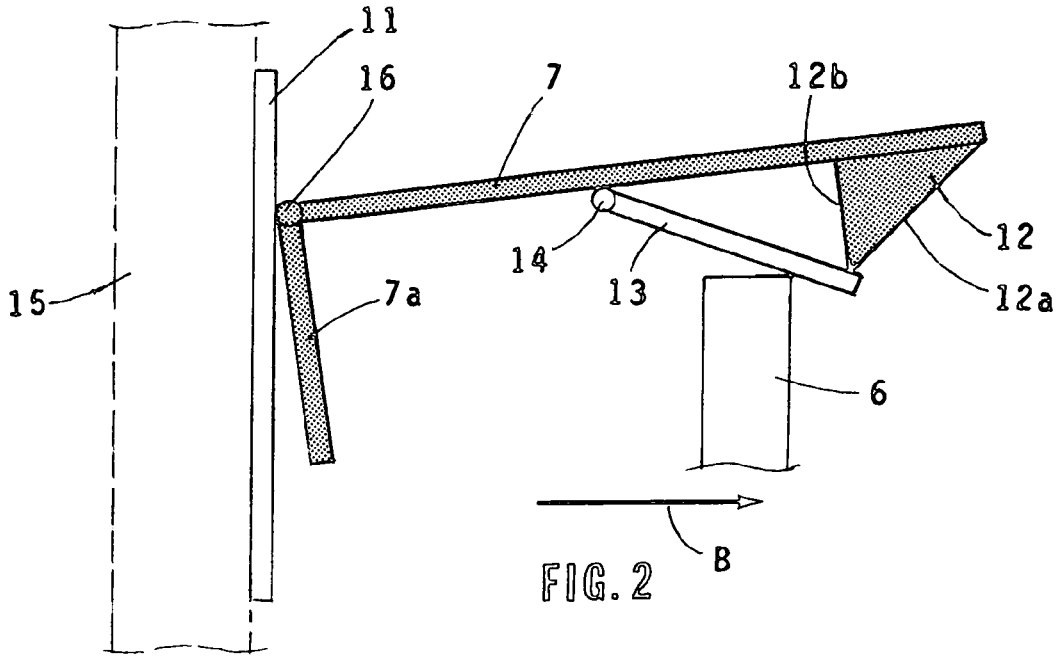
FIG. 2 is a side elevational view of the embodiment of FIG. 1 Showing the door being urged to its closed position.

Referring to FIGS. 1 and 2, a first embodiment of the invention is illustrated.

Mounting bracket 11 is fixedly attached to a portion of wall 15 adjacent to the hinged end of door 6. Latch 7 is pivotally supported on bracket 11 by means of pivotal connector 16 which is fixedly attached to the bracket. Release lever 13 is pivotally mounted on latch 7 by means of pivotal connector 14 which is fixedly attached to the latch. An end piece 12 having a ramped end surface 12*a* and a substantially flat inner surface 12*b* is formed at the remote end of latch 7.

The device of the invention operates as follows: When the door 6 is moved towards its open position, as indicated by arrow "A" in FIG. 1, as it nears its fully open position, it contacts the ramped surface 12*a*, the door being shown in dashed form as "6*a*". As the door moves further towards the wall 15 it rides along the ramped surface 12*a* and drives latch 7 upwardly on its pivotal connector 16. The door 6 will ride over the bottom edge of the ramped surface and enter the space between inner surface 12*b* of the ramp and release lever 13, as can be seen in FIG. 1. When the door is further moved in the open direction "A" towards wall 15, it will abut against pivotally supported release lever 13, moving this lever upwardly. The door, shown in dashed lines as "6*b*", enters the space between release lever 13, which returns to its vertical position, and the vertical portion 7*a* of pivoting latch 7.

Referring to FIG. 2, the door can now be closed merely by pushing it in the closed direction as indicated by arrow "B". The door will ride up along the ramped surface formed by release lever 13 in abutment against end piece 12. The release lever drives the end piece 12 and along with it latch 7 upwardly on its pivot, permitting the top end of the door to pass over the end piece and go towards the closed position.

Figure 3:
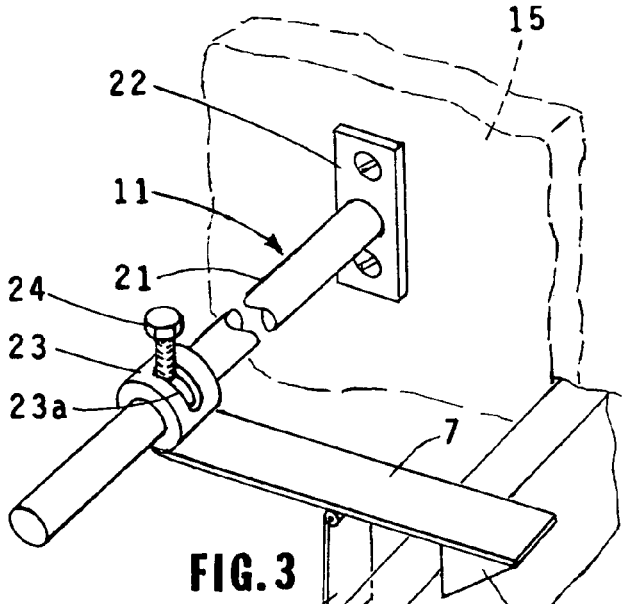
FIG. 3 is a top perspective view of a second embodiment of the invention.

Referring now to FIG. 3, a second embodiment of the invention is illustrated. The mounting bracket 11 is formed by rod 21, which is fixedly mounted by means of support member 22 on the wall 15 behind the inner end of the door. Latch 7 is pivotally supported on rod 21 near the end thereof by means of sleeve 23, which is fixedly attached to the latch 7 and permitted to move pivotally on rod 21 about ninety degrees. This result is achieved by means of a slot 23*a* formed in the sleeve. A screw fits through the slot 23*a* and threadably engages a threaded hole in the rod 21 thereby limiting the pivotal travel of latch 7. The basic operation is the same as that described in connection with FIGS. 1 and 2. This embodiment is adapted for use in situations where the support wall is parallel to the closed door.

Figure 4:
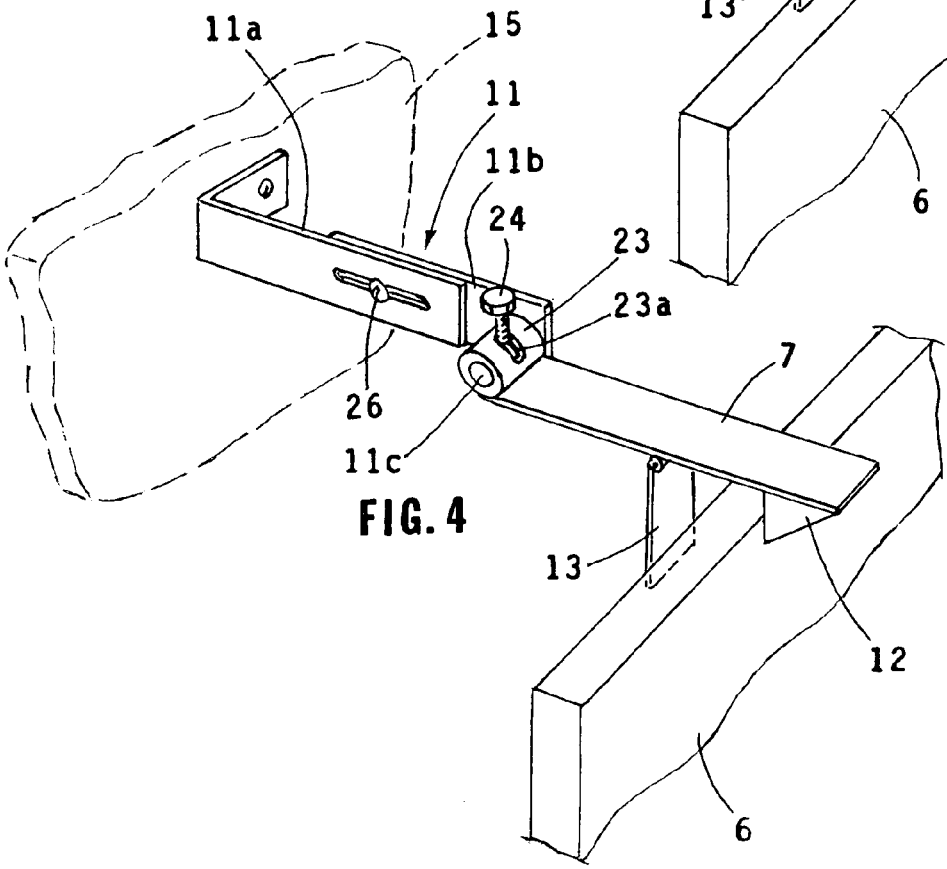
FIG. 4 is a top perspective view of a third embodiment of the invention.

Referring to FIG. 4, a third embodiment of the invention is shown. Mounting bracket 11 is formed in an L shape and attached to a wall portion 15 adjacent to the door. The bracket is formed in two sections 11*a* and 11*b*, which are adjustably connected to each other by means of screw 26, which fits into a slotted portion of section 11*a* and threadably engages section 11*b*. The latch 7 has a circular sleeve 23 fixedly attached to the inner end thereof. Bracket section 11*b* has a pin 11*c* which pivotally fits into circular sleeve 23. Sleeve 23 has a slot 23*a* formed therein through which screw 24 fits and is threadably attached to a threaded hole in pin 11*c*. The slot and screw permit pivotal motion of only about ninety degrees. This embodiment is adapted for use where the door support wall is normal to the door when the door is closed.

The embodiments of FIGS. 3 and 4 operate in the same general manner as the embodiments of FIGS. 1 and 2 and facilitate installation of the device of the invention in various situations such as where the only wall available for mounting the device is parallel to the closed door or at right angles to the closed door.

Figure 5:
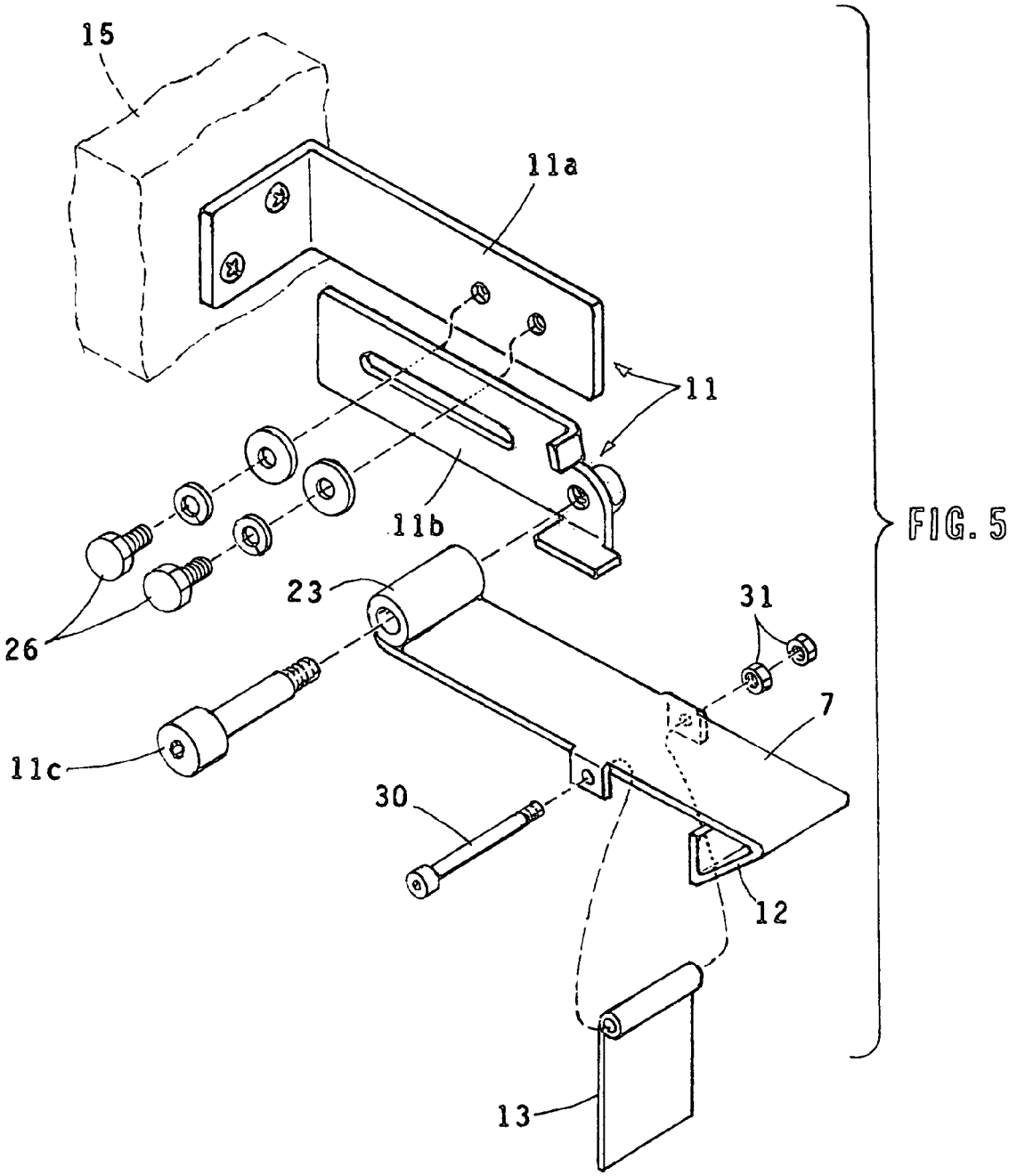
FIG. 5 is a top perspective exploded view of a fourth embodiment of the invention.
Figure 7:
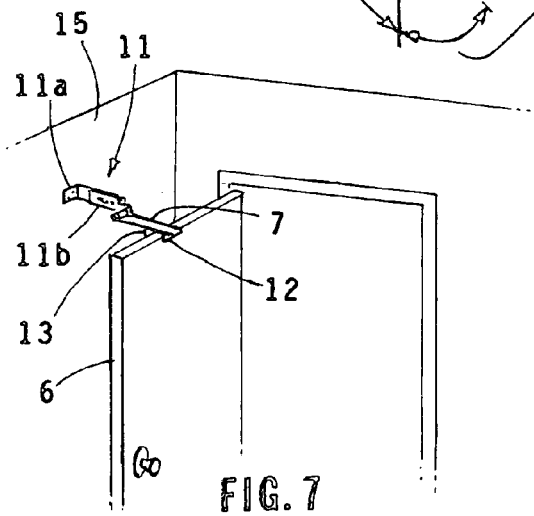
FIG. 7 is a top perspective view illustrating the attachment of the device of the invention to a wall at right angles to the wall on which the door is supported.

Referring no to FIG. 5, a fourth embodiment of the invention is illustrated. This embodiment is similar to that of FIG. 4 and includes a support bracket 11 having two sections 11*a* and 11*b*. Section 11*a* is L-shaped and has a portion, which is fixed attached to wall 15. Section 11*b* has a slotted portion through which screws 26 fit and threadably engage threaded holes formed in section 11*a* thereby enabling the longitudinal positioning of the two sections relative to each other and lengthening or shortening the support bracket. Latch 7 has a sleeve 23 fixedly attached to one end thereof, the sleeve being pivotally supported on screw or pin 11*c* which threadably engages a threaded hole formed in the end of bracket portion 11*b* and is held non-rotatably on this bracket portion. Release lever 13 is rotatably supported on latch 7 by means of bolt 30, which is held fixedly on latch 7 by means of nuts 31. End piece 12 is integrally formed with latch 7 as an inwardly bent end portion of the latch. The device of this embodiment is suitable for use where the end piece 11 is supported on a wall at right angles to the wall on which the door is mounted, as illustrated in FIG. 7.

Figure 6:
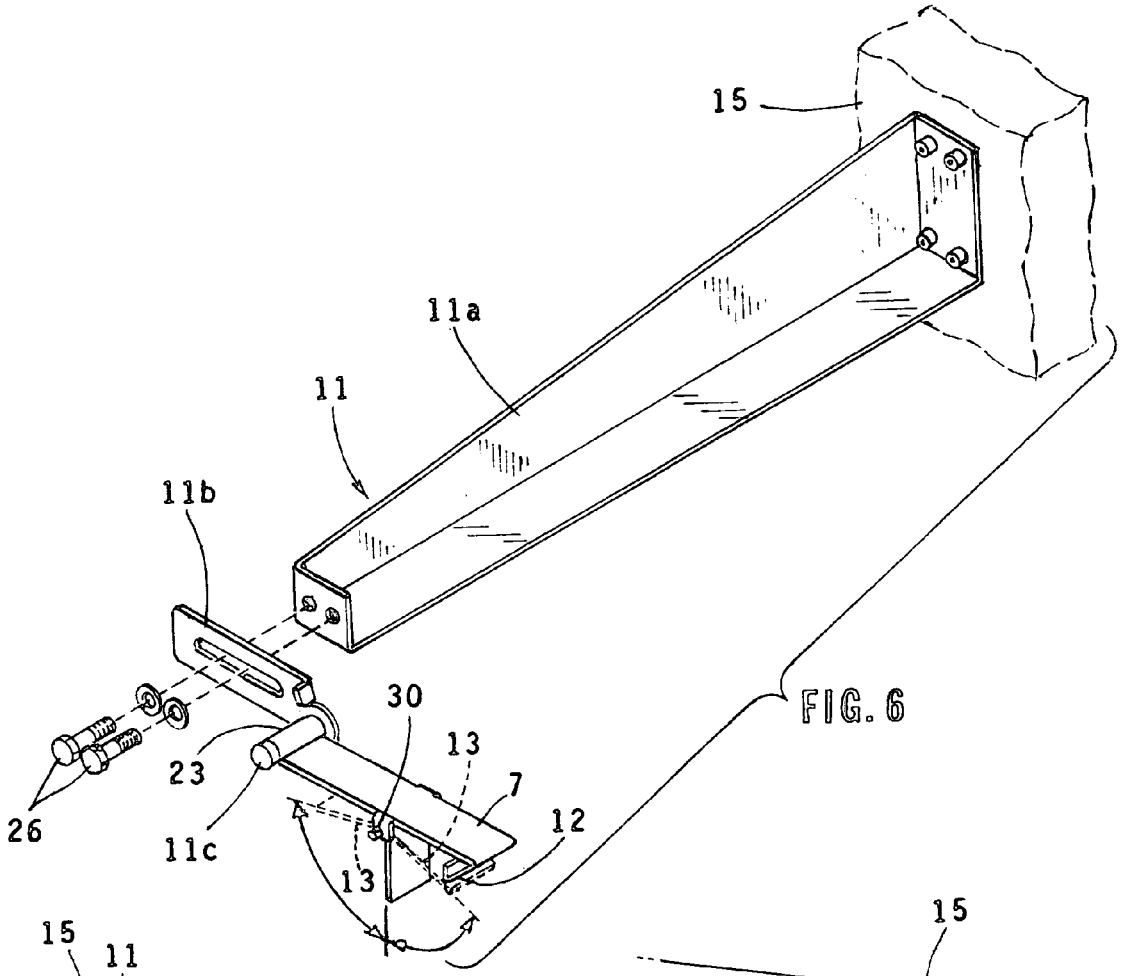
FIG. 6 is a top perspective exploded view of a fifth embodiment of the invention.
Figure 8:
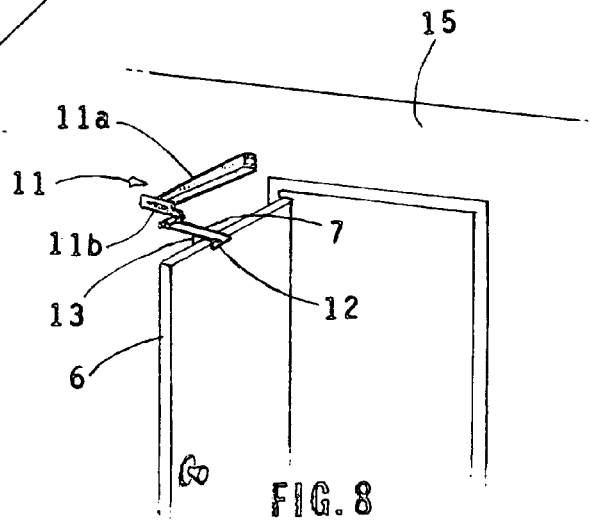
FIG. 8 is a top perspective view illustrating the attachment of the device of the invention to the wall on which the door is supported.

Referring now to FIG. 6, a fifth embodiment of the invention is illustrated. This embodiment has the same structure for latch 7, release lever 7, and bracket section 11*b* as in the embodiment of FIG. 5. The bracket section 11*b* is adjustably attached to an elongated bracket section 11*a* which is attached to wall 15. The operation of this embodiment is the same as that of the previous embodiments, the only difference being that it provides for mounting on a side wall substantially at right angels to the wall on which the door is mounted, as illustrated in FIG. 8.

While the invention has been described and illustrated in detail, this is intended by way of illustration and example only and not by way limitation, the spirit and scope of the invention being limited by the terms of the following claims.

We claim:

1. A device for holding a door hinged to a wall on one end thereof open and for releasing the door so that it closes comprising:

a mounting bracket fixedly attached to said wall end adjacent to said one hinged end of said door;

a latch pivotally supported on said bracket at one end thereof;

a release lever pivotally supported on said latch; and an end piece attached to the end of said latch opposite to said one end thereof, said end piece having a ramped outer surface;

said door moving over said ramped surface when it is brought toward its fully open position and when fully open retained between said release lever and said latch.

2. The device of claim 1 wherein the mounting bracket is in the form of a rod.

3. A device for holding a door hinged to a wall on one end thereof open and for releasing the door so that it closes comprising:

a mounting bracket in the form of a rod fixedly attached to said wall;

a latch pivotally supported on said bracket at one end thereof, said latch including a sleeve fixedly mounted thereon, said sleeve being pivotally supported on said rod shaped bracket;

a release lever pivotally supported on the latch; and an end piece attached to the end of said latch opposite to said one end thereof, said end piece having a ramped outer surface;

said door moving over said ramped surface when it is brought toward its fully open position and when fully open retained between said release lever and said latch.

4. The device of claim 3 wherein said sleeve has a slot formed herein and a screw attached to said rod installed in said sleeve.

5. A device for holding a door hinged to a wall on one end thereof open and for releasing the door so that it closes comprising:

a mounting bracket fixedly attached to said wall;

a latch pivotally supported on the bracket at one end thereof, a sleeve fixedly attached to the latch, said sleeve being pivotally supported on said bracket;

a release lever pivotally supported on the latch, and an end piece attached to the end of said latch opposite to said one end thereof, said end piece having a ramped outer surface;

said door moving over said ramped surface when it is brought toward its fully open position and when fully open retained between said release lever and said latch.

6. The device of claim 5 wherein said sleeve has a longitudinal slot formed therein, a screw mounted in said slot and fixedly attached to said latch.

7. A device for holding a door hinged to a wall on one end thereof open and for releasing the door so that it closes comprising:

a mounting bracket fixedly attached to said wall;

an L-shaped latch pivotally supported on said bracket at one end thereof;

a release lever pivotally supported on the latch; and an end piece attached to the end of said latch opposite to said one end thereof, said end piece having a ramped outer surface;

said door moving over said ramped surface when it is brought toward its fully open position and when fully open retained between said release lever and said latch.

8. A device for holding a door hinged to a wall on one end thereof open and for releasing the door so that it closes comprising:

a mounting bracket fixedly attached to said wall, said mounting bracket having two sections, one of said sections having a longitudinal slot formed therein and a screw extending through said slot and attached to the other of said sections, thereby permitting the adjustment of the length of said mounting bracket;

a latch pivotally supported on said bracket at one end thereof;

a release lever pivotally supported on the latch; and an end piece attached to the end of said latch opposite to said one end thereof, said end piece having a ramped outer surface;

said door moving over said ramped surface when it is brought toward its fully open position and when fully open retained between said release lever and said latch.

* * * * *